US005749039A

United States Patent [19]

Thomas

[11] Patent Number: 5,749,039

[45] Date of Patent: May 5, 1998

[54] COLLAPSIBLE AIR PLENUM

[75] Inventor: Dean Thomas, Webster, N.Y.

[73] Assignee: Xerox Corporation, Stamford, Conn.

[21] Appl. No.: 751,346

[22] Filed: Nov. 19, 1996

[51] Int. Cl.[6] ..... G03G 15/00

[52] U.S. Cl. ..... 399/397; 271/194; 271/197; 399/92

[58] Field of Search ..... 399/92, 381, 397, 399/400, 361; 271/194, 195, 196, 197, 276

[56] References Cited

U.S. PATENT DOCUMENTS

| | | | |
|---|---|---|---|
| 3,826,568 | 7/1974 | Hudson . | |
| 4,017,065 | 4/1977 | Poehlein | 271/80 |
| 4,362,380 | 12/1982 | Dragstedt | 271/276 X |
| 4,595,283 | 6/1986 | Bartz et al. | 271/194 X |
| 5,031,002 | 7/1991 | Yaguchi | 271/196 X |
| 5,063,415 | 11/1991 | Ariyama | 271/194 X |
| 5,166,735 | 11/1992 | Malachowski . | |
| 5,223,903 | 6/1993 | Russel et al. | 271/195 X |
| 5,392,107 | 2/1995 | Paxon et al. | 271/197 X |
| 5,411,251 | 5/1995 | Schmid et al. | 271/195 |
| 5,467,180 | 11/1995 | Malachowski et al. . | |
| 5,548,388 | 8/1996 | Schieck | 271/197 X |

*Primary Examiner*—Sandra L. Brase
*Attorney, Agent, or Firm*—John M. Kelly

[57] ABSTRACT

A substrate transport assembly having an air mover that moves air through an air housing such that a substrate is biased against a drive member. The substrate assembly further includes an air plenum that receives moving air and directs that air along a predetermined path. The air plenum expands when air is moving but is otherwise collapsed.

5 Claims, 4 Drawing Sheets

COLLAPSIBLE AIR PLENUM

FIELD OF THE INVENTION

The present invention relates generally to air plenums, and more particularly to air plenums used in electrophotographic printing machines.

BACKGROUND OF THE INVENTION

Electrophotographic marking is a well known method of copying or printing documents or other substrates. Electrophotographic marking is performed by projecting a light representation of a desired final image onto a charged photoreceptor. That light image discharges the photoreceptor so as to create an electrostatic latent image of the desired image on the photoreceptor's surface. Toner particles are then deposited onto that latent image, forming a toner image. That toner image is subsequently transferred, either directly or after an intermediate transfer step, onto a substrate and then fused onto that substrate, thereby forming the a final image. The surface of the photoreceptor is then cleaned of residual developing material and recharged in preparation for the creation of another image.

In practice, the foregoing process depends upon movement. For example, the photoreceptor moves through a charging station, an exposure station, a developing station, and a transfer station. Another example, one more pertinent to the present invention, the substrate moves through the transfer station and the fusing station. Since unfused toner particles are easily disturbed, moving the substrate from the transfer station to the fusing station must be performed with care to prevent disturbing the toner particles. A device that moves the substrate with the toner particles is referred to herein as a prefuser transport.

Prefuser transports usually include a rotating belt or drum that moves the substrate. An air blower is often used to develop a vacuum (actually a low pressure gradient, but commonly referred to as a vacuum) that holds the substrate to a belt or drum. For example, U.S. Pat. No. 4,017,065, issued to inventor Poehlein on 12 Apr. 1977 describes a vacuum transport for moving a substrate from an image transfer area to a fuser roll nip. In operation, the transport forms a buckle in the intermediate portion of the substrate to compensate for a speed mismatch between the fuser roll nip and the initial image support surface. A manifold having separate plenum chambers controls the buckle by cyclic reductions in the vacuum applied to the plenum closest to the fuser roll nip. The removal of vacuum from a chamber is accomplished by an electrically operated valve that opens a vent in the manifold top cover to an outside atmosphere. Also, U.S. Pat. No. 5,166,735, issued to Malachowski on 24 Nov. 1992 discloses a substrate transport incorporating a control for matching drive speeds imparted to a substrate extended between a fuser roll nip and an image transfer area. The transport contains a vacuum plenum which communicates with a receiving surface on the transport. The substrate is engaged by the transport and is adhered to the receiving surface by the vacuum. The fuser rolls are driven at a slightly higher speed to tension the substrate and lift it from the transport surface. The lifting is detected by a sensor that senses the vacuum in the plenum and accordingly adjusts the drive speed of the fuser rolls. Additionally, see U.S. Pat. No. 5,467,180, issued to Malachowski et al. on 14 Nov. 1995.

While the use of air blowers is beneficial, such blowers require an air plenum to develop the vacuum forces. In the prior art such air plenums were rigid structures located such that the low pressure created by the air blower produced the desired pressure gradient. Furthermore, to enable servicing of interior components of a printing machine, prior art printing machines required additional space between the air plenum and those other components. However, in many modern systems space is at a premium. Unfortunately, to develop the required air pressure gradient within a given system an air plenum of a certain volume is required. Therefore, an air plenum that meets the volume requirements of the air system, while enabling a reduction in the space requirement between itself and the other components of the system would be beneficial.

SUMMARY OF THE INVENTION

The principles of the present invention provide for a printing machine having a collapsible air plenum. Such an air plenum expands during operation to meet the needs of the air system yet collapses to provide access to the areas surrounding the air plenum. Beneficially, the air plenum is used in conjunction with an air moving system that includes an air blower and a moving member, such as a belt or drum, wherein the air plenum cooperates with the air moving system such that a substrate can attach to the moving member via air pressure.

BRIEF DESCRIPTION OF THE DRAWINGS

Other aspects of the present invention will become apparent as the following description proceeds and upon reference to the drawings, in which.

In the drawings, like numbers designate like elements. Additionally, the text includes directional signals that are taken relative to the drawings (such as right, left, top, and bottom). Those directional signals are meant to aid the understanding of the present invention, not to limit it.

DETAILED DESCRIPTION OF THE PREFERRED EMBODIMENT

While the principles of the present invention are subsequently described in connection with a preferred embodiment electrophotographic printing machine, it should be understood that it those principles are not limited to that embodiment. On the contrary, the principles of the present invention are intended to cover all alternatives, modifications and equivalents that may be included within the spirit and scope of the invention defined by the appended claims.

Figure 1:
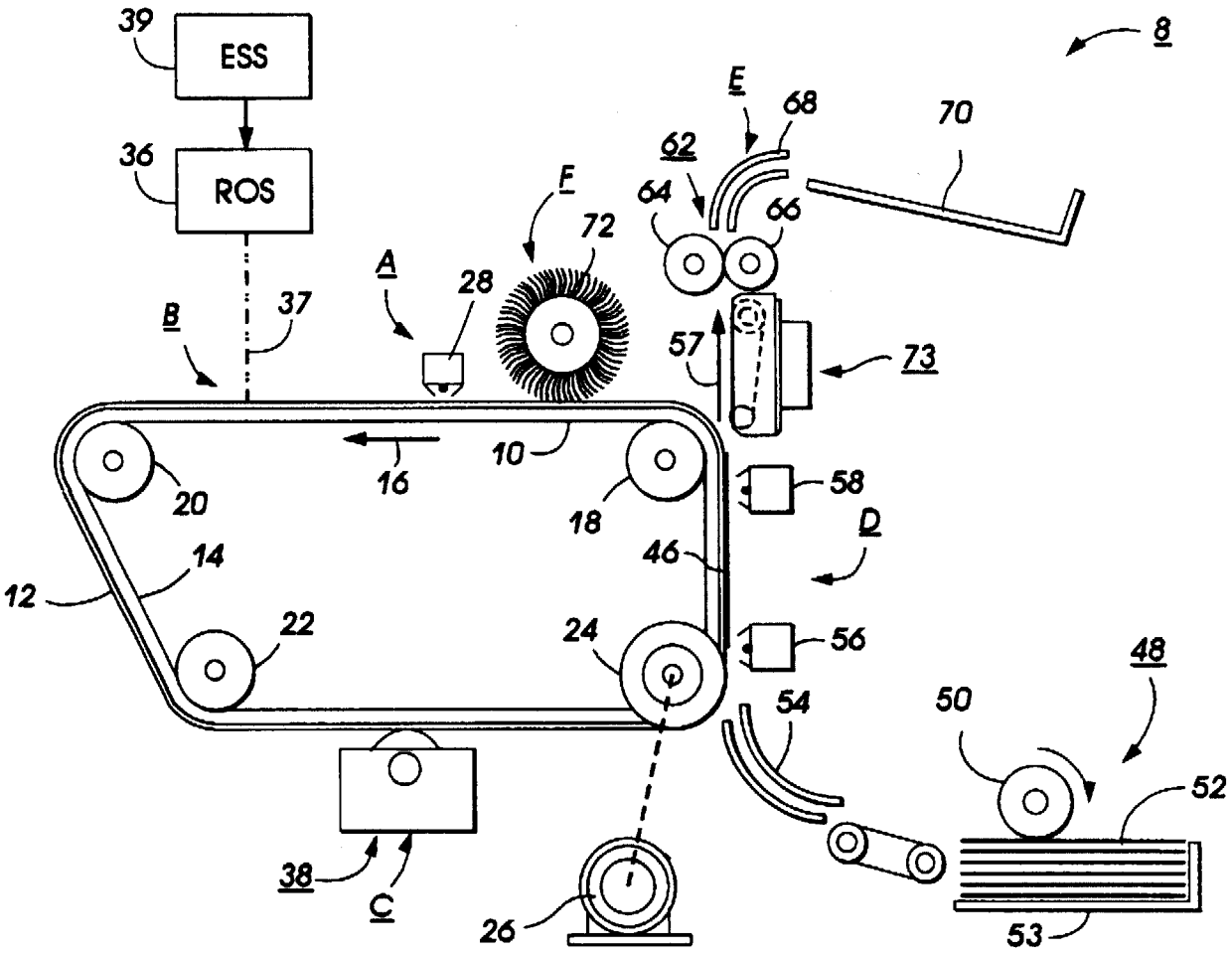
FIG. 1 is a schematic, elevational view of an illustrative printing machine.

Reference is now made to FIG. 1, which schematically depicts various elements of an illustrative printing machine 8 that incorporates the present invention. That printing machine employs a belt 10 having a photoconductive surface 12 that is deposited on a conductive substrate 14. By way of example, the photoconductive surface 12 may be a selenium alloy while the conductive substrate 14 may be an aluminum alloy. The belt 10 moves in the direction of arrow 16 so as to advance successive portions of photoconductive surface 12 through the various processing stations that are disposed about the belt. As shown, the belt is entrained about rollers 18, 20, 22, and 24. The roller 24 is coupled to a motor 26 that drives the roller 24 so as to move the belt 10 at a constant velocity in the direction of the arrow 16.

For convenience, a single section of the photoconductive surface 12, that section being referred to as the image area, is identified. The image area is that part of the photoconductive surface that is operated on by the various processing stations to produce toner layers. While the photoconductive surface may have numerous image areas, since each image area is processed in the same way a description of the processing of one image area suffices to explain the operation of the printing machine 8.

When the image area passes through charging station A, a corona generating device, indicated generally by the reference numeral 28, charges the image area to a relatively high, substantially uniform potential. As the image area advances it passes through exposure station B. At exposure station B, a raster output scanner 36 produces a laser beam 37 that raster scans the image area so as to expose the image area in a series of horizontal lines, with each line having a specific number of pixels (pixel elements) per inch. The laser beam is modulated according to the output of an electronic subsystem 37 such that a desired electrostatic image is produced on the photoconductive surface. The electronic subsystem, which represents the control electronics for the raster output scanner, may be a self-contained, dedicated minicomputer.

After passing through the exposure station B the image area, with its latent image, advances to a development station C. At development station C, a magnetic brush developer system, indicated generally by the reference numeral 38, transports developer material, carrier granules having toner particles adhering triboelectrically thereto, into contact with the latent image. Toner particles are attracted from the carrier granules to the latent image, forming a toner image on the image area. While dry developer material has been described, one skilled in the art will appreciate that a liquid developer material also may be used.

After through the development station, the image area and its toner image advance to transfer station D. At transfer station D, a substrate 46, such as a sheet of paper, is moved into contact with the toner image (see below). The Image transfer station D includes a corona generating device 56 that applies electrostatic transfer charges to the backside of the substrate such that the substrate is electrostatically tacked onto the belt 10. The electrostatic transfer charges also attracts the toner image from image area onto the substrate. After transfer, the lead edge of the substrate is moved under a detacking corona generator 58. The detacking corona generator applies ions to the substrate so as to neutralize most, but not all, of the tacking charge. It is desirable to leave some of the transfer charges on the substrate so as to retain the toner image on the substrate. However, the detack corona generator does produce enough ions that the substrate self strips from the belt 10.

Prior to the substrate contacting the image area, the substrate was the uppermost substrate of a stack 52 of substrates in a bin 53. To move the substrate 46 from the stack, a feed roll 50 of a sheet feeding apparatus 48 contacts the substrate and advances it via chute 54 into contact with the belt 10 in a sequence timed so that the advancing substrate contacts the toner image.

After the lead edge of the substrate 46 self strips from the belt 10, the substrate moves beneath a prefuser transport 73. The prefuser transport 73 receives the substrate 46 with the unfused toner image and advances it in the direction of arrow 57 to a Fusing Station E. As the principles of the present invention are best described with specific reference to the operation of the pretransport fuser, the pretransport fuser is described in more detail subsequently.

Still referring to FIG. 1, the fusing station E includes a fuser assembly, indicated generally by the reference numeral 62, which permanently affixes the toner image to the substrate 46. Preferably, the fuser assembly 62 includes a heated fuser roll 64 and a back-up roll 66. The substrate passes between the fuser roller 64 and the back-up roll 66 such that the toner image contacts the fuser roll 64. Heat from the fuser roll 64 and the pressure in the dip between the fuser roller and the back up roll 66 permanently fuse the toner image to the substrate. After fusing, a chute 68 guides the advancing substrate to a catch tray 70 for subsequent removal by an operator.

Invariably, after a substrate separates from the belt 10 residual particles comprised of toner, dirt, dust, paper fibers and/or other matter, remain on the belt. Those residual particles are removed from the belt at a cleaning station F. Cleaning station F includes a pre-clean corona generating device (which is not shown for clarity) and a rotatably mounted fibrous brush 72 that contact the belt. The pre-clean corona generator neutralizes any charges that attract the residual particles to the belt while the rotation of the brush 72 cleans the belt. Those skilled in the art will appreciate that cleaning also may be used performed in a number of other ways, such as with a blade cleaner. After cleaning, a discharge lamp (also not shown for clarity) floods image area with light so as to dissipate any residual charges on the belt prior to charging for the next imaging cycle.

As previously indicated, the principles of the present invention are best described with specific reference to the operation of the prefuser transport 73. To better understand the environment in which the principles of the present invention operate, additional information regarding separating a substrate from a belt is beneficial. With continued reference to FIG. 1, a drive force is applied to the substrate as it is acquired by prefuser transport 73. That drive force is a function of the internal pressure of the transport 73, the coefficients of friction between the substrate and the belt 10 and between the substrate and the prefuser transport, the contact area of the transport, and the tack force of the substrate to the belt. If the drive force exceeds the tack force, image quality may be degraded when the substrate separates from the belt because of smears and skips that might occur on the unfused toner image being transferred to the trailing edge of the substrate. The difference between the transport drive force and the tack force also affects the motion quality of the belt. As the substrate separates from the belt any transient jolts are transmitted directly to the belt. This applies a temporary additional load to the belt drive system which may occur too quickly for the drive system to compensate for. This may degrade subsequent images. To prevent image degradation, the prefuser transport 73 is driven slightly faster than the belt 10. Proper tensioning requires that the drive force of the prefuser transport 73 be less than the tacking force. That tacking force depends upon the charging parameters of the transfer corona generator 56 and the detack corona generator 58, the tack zone area between those generators, the velocity of the substrate, the geometry of the copy sheet path, and the copy quality requirements.

Figure 2:
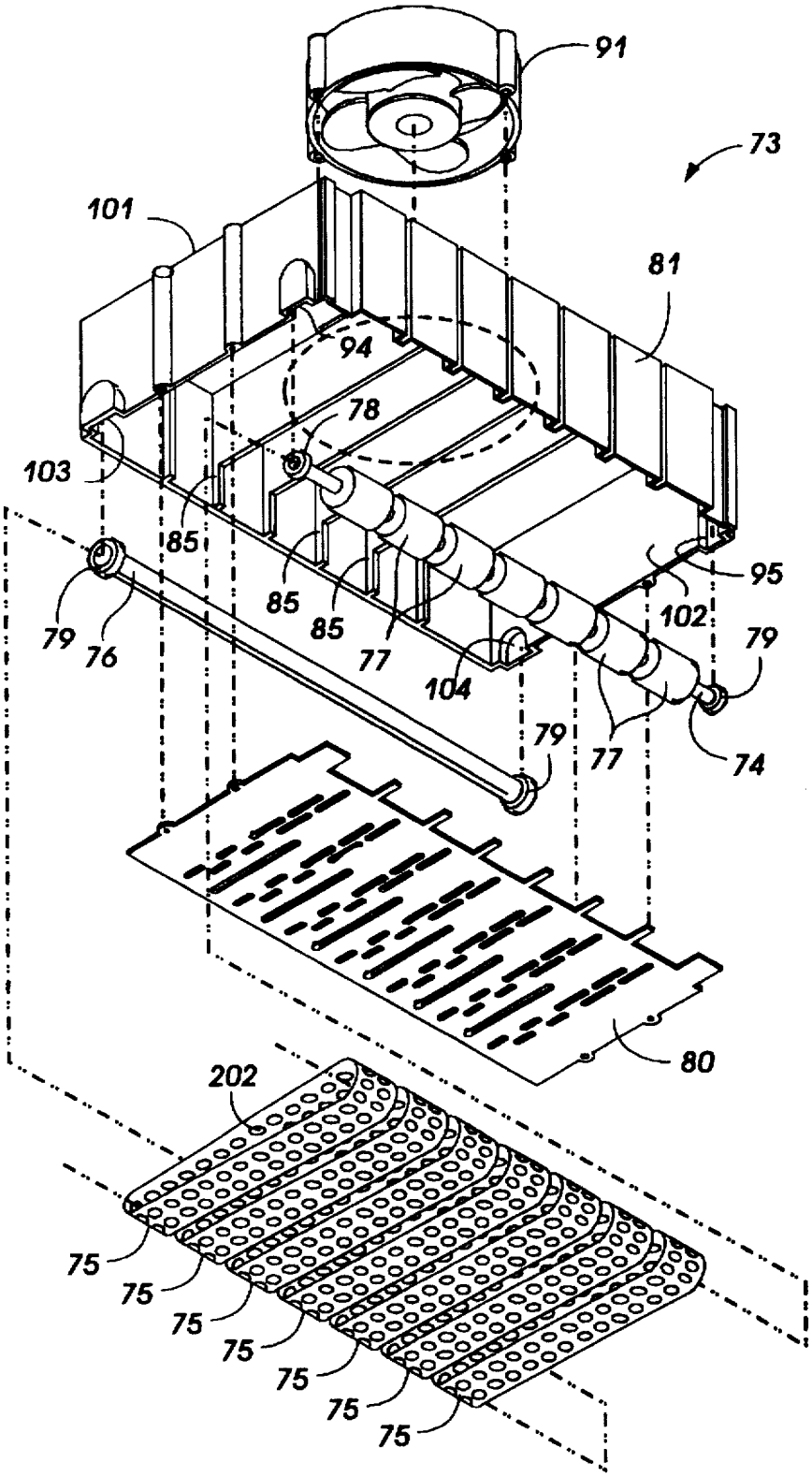
FIG. 2 is a perspective view of a substrate transport system used in the illustrative printing machine.

Turning now to FIG. 2, the prefuser transport 73 has a sheet receiving surface comprised of a plurality of foraminous belts 75 that are contained within a rigid transport housing cover 81. Belt widths of 1.0 inch, with lands of 0.6 inches are chosen to moderate belt drag over a plenum surface 80, over which plenum housing cover 81 is mounted. The foraminous belts 75 are entrained over a plurality of drive rollers 77 and an idler shaft 76. Drive rollers 77 are fixedly mounted on a drive shaft 74 which is driven by a motor or other type of drive system (not shown). A pair of roller bearings 78 are journaled on opposite ends of the drive shaft 74. The roller bearings 78 engage slots 94 and 95 located respectively on sides 101 and 102 of plenum housing cover 81. Slots 103 and 104 located likewise on sides 101 and 102 of plenum housing cover 81 are engaged by roller bearings 79 which are journaled on opposite ends of idler shaft 76. An air moving device, such as, Muffin fan 91 located atop plenum housing cover 81 provides an open port air flow in excess of 60 CFM for sheet acquisition. Muffin fan 91 also provides a closed port vacuum pressure of approximately 0.3 inches of water pressure to limit the drive force on the copy sheet to approximately 0.3 pounds of force. A plurality of anti-swirl vanes 85 located inside plenum housing cover 81 prevent the occurrence of whirlwinds that cause a local variation from the average or normal air flow through plenum housing cover 81.

Figure 3:
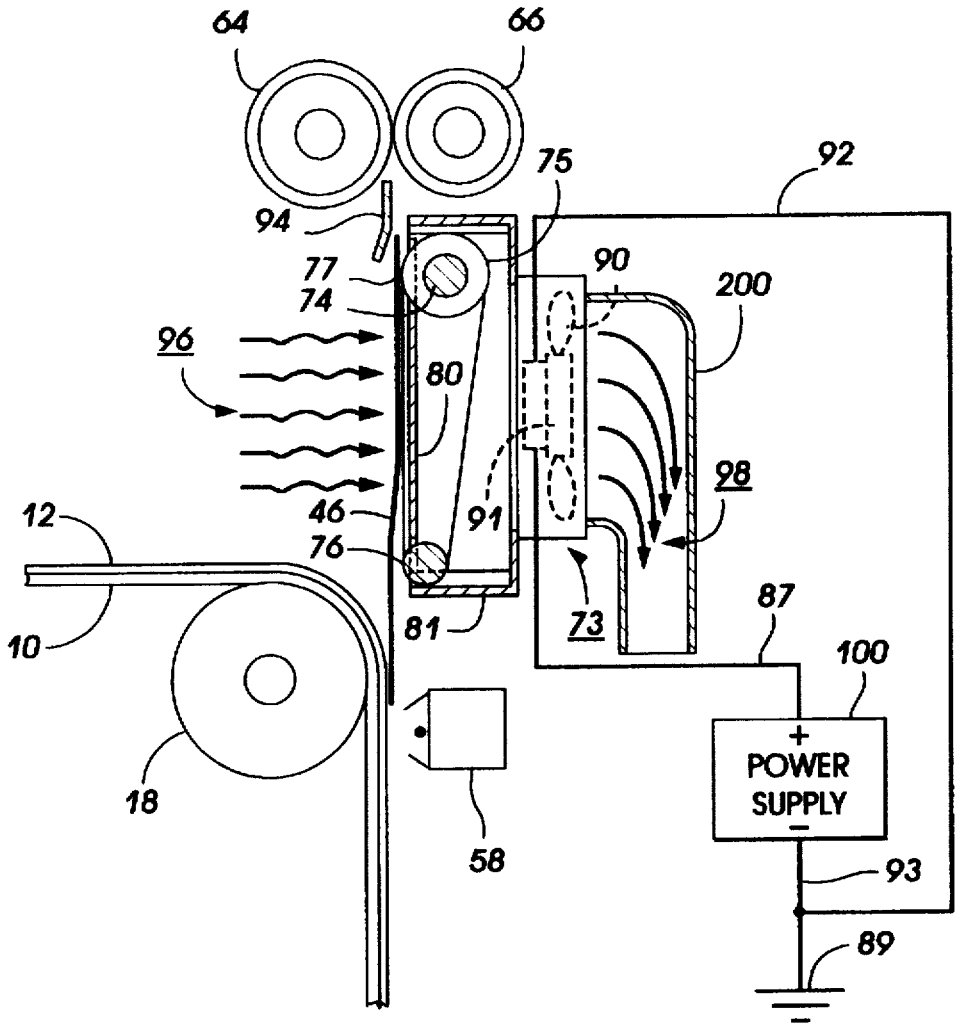
FIG. 3 is a schematic depiction of the air moving system used in the illustrative printing machine.

Since the fan 91 moves a substantial quantity of air, it is necessary to divert the air away from the belt and the various process stations. Beneficially, the air is diverted using an exhaust plenum to an exhaust port. Turning now to FIG. 3, the prefuser transport 73 with an exhaust plenum 200 is shown in operation. The prefuser transport 73 is beneficially located 1 to 3 millimeters above the 10 and such that the plenum surface 80 is coplanar with the belt 10. The foraminous belts 75 are driven at a velocity approximately 0.85% greater than the velocity of belt 10 to maintain tension on the substrate 46 when the substrate spans the distance between the belt 10 and the prefuser transport 73. Air pressure inside the enclosed space of the plenum housing cover 81 is greater than the outside atmosphere. Air is forced into the plenum for distribution through it. Fan 91 having rotating blades 90 mounted thereon creates a negative air pressure or vacuum beneath the prefuser transport 73 by drawing in air as generally indicated by arrows 96. Air flow 96 sucks the copy sheet 46 against a plurality of vacuum holes 202 (see FIG. 2 shown) in the foraminous belts 75. Air is discharged from the exhaust side of fan 91 into the exhaust plenum 200 as indicated by arrows 98. The fan 91 is connected to a positive terminal on power supply 100 through a lead 87. The negative terminal of power supply 100 is connected to ground 89 via a lead 93. Likewise, the return side of fan 91 is connected to ground 89 through a lead 92 to complete an electrical circuit that energizes fan 91.

With continued reference to FIG. 3, when the lead edge of the substrate passes under the detack corona generator 58 the transfer charge is neutralized. The substrate self strip from the belt 10. The lead edge of the substrate becomes airborne until it is acquired by the prefuser transport 73. As that lead edge contacts the transport air is drawn by fan 91 with minimum impedance, through ports in the plenum surface 80. The open ports enable a high air flow for acquisition close to photoconductive belt 10. Air drawn through the transport is discharged from the exhaust side of fan 91 into the exhaust plenum 200. The substrate then moves onto the transport 73, closing the ports on the plenum surface 80. The closed ports impede the air flow, thereby causing a low pressure vacuum within the plenum housing cover 81. The vacuum sucks the substrate 46 up against the prefuser transport 73, where it adheres to the holes in belts 75. The substrate is then advanced by the foraminous belts 75. The drive force acting upon the substrate 46 is a function of the internal vacuum pressure of transport 73, the contact area between the substrate and the belts 75, and the coefficient of friction of the belts 75. The fan 91 continually runs to maintain the drive force exerted on the substrate to be somewhat less than the tacking force of the substrate on the belt. With the drive force exerted on the substrate by belts 75 being lower than the tacking force the substrate slips on the belts until its trail edge breaks free from the belt. The substrate is then moved by the transport 73 to a guide 94, which guides the leading edge of the substrate into the nip formed by the fuser roll 64 and the pressure roll 66.

As mentioned above, the air moved by the fan 91 is exhausted into the exhaust plenum 200 for diversion to an exhaust port. That exhaust plenum is constructed of a collapsible material, beneficially of plastic. By collapsible it is meant that the exhaust plenum is constructed such that air flow from the fan expands the exhaust plenum, but that when the air flow stops the exhaust plenum collapses.

Figure 4:
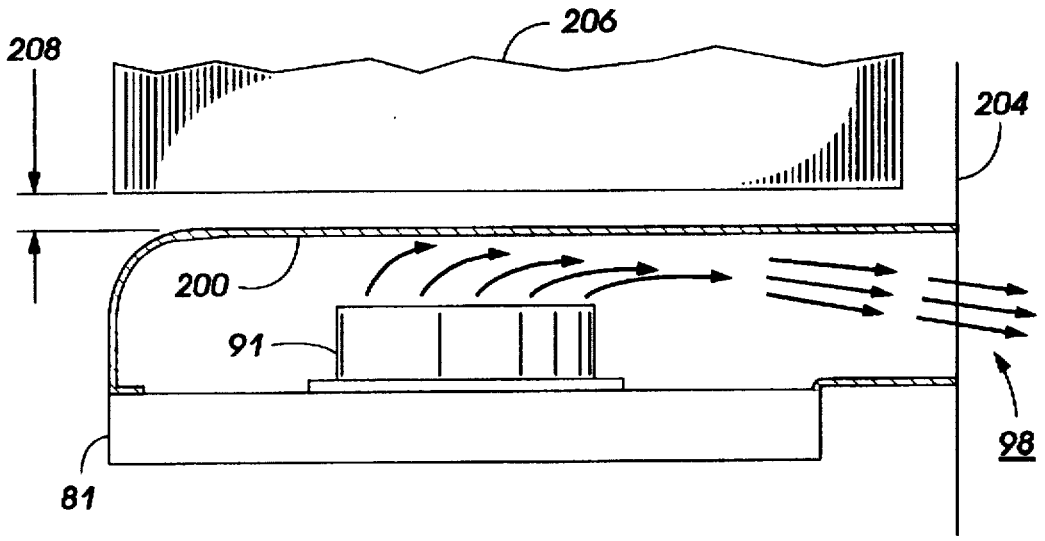
FIG. 4 is a plan view showing a collapsible air plenum used in the illustrative printing machine and its relationship to an adjacent component when that air plenum is inflated.
Figure 5:
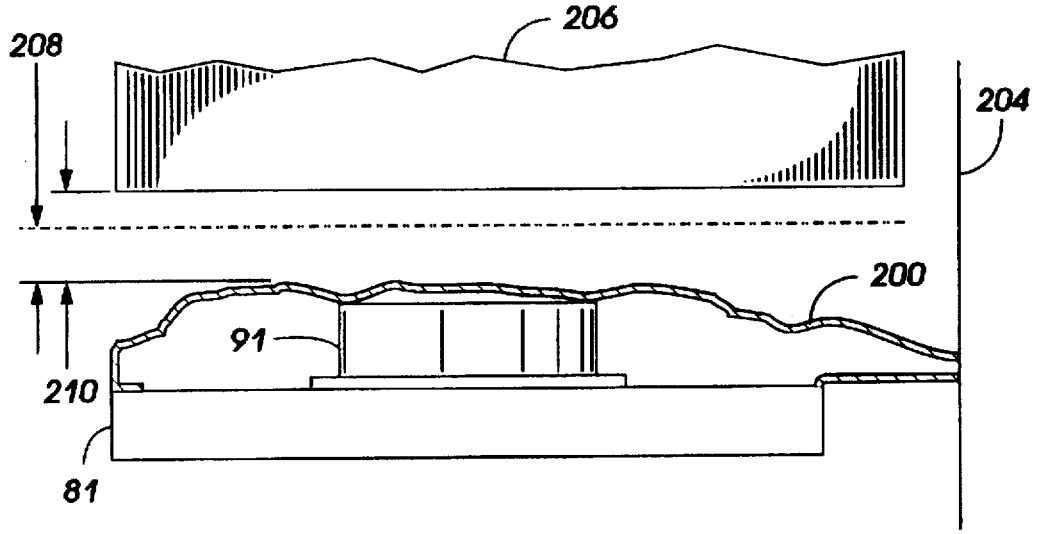
FIG. 5 is a plan view showing the collapsible air plenum of FIG. 4 when that air plenum is deflated.

An advantage of a collapsible exhaust plenum is explained with the assistance of FIGS. 4 and 5. As shown in FIG. 4, with the fan 91 blowing air the exhaust plenum 200 expands under the force of that air flow 98. The air then guided out of an exhaust port 204. Further as shown in FIG. 4 is a component 206 that is separated from the exhaust plenum 200 by a space 208 (which could be zero in that the component 206 and the exhaust plenum touch). That component 206 could be any device, element or structure interior to the printing machine 8.

However, when the printing machine is not functioning, such as during service or maintenance, the fan 91 stops blowing air. The result is shown in FIG. 5. Without the force of the air from the fan the exhaust plenum 200 collapses. This collapse increases the distance 210 between the component 206 and the exhaust plenum. Thus the distance 210 is greater than the distance 208, allowing easier service or maintenance.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A substrate transport assembly, comprising:

an air housing having an air outlet port;

an air mover for selectively moving air through said air outlet port;

a drive assembly for receiving and moving a substrate, said drive member positioned such that when said air mover moves air that a substrate received by said drive member is biased against said drive member; and an air plenum comprised of a flexible material, said air plenum for receiving air from said air outlet port and for directing that air along a first path, wherein said air plenum expands when air is moved by said air mover, and wherein said air plenum collapses when air is not moved by said air mover.

2. A substrate transport assembly according to claim 1, wherein said drive member includes a plurality of moving belts entrained about a driven member.

3. A substrate transport assembly according to claim 2, wherein said moving belts include a plurality of apertures.

4. A substrate transport assembly according to claim 1, wherein said air mover includes a motor driven air blower.

5. A substrate transport assembly according to claim 1, wherein said air plenum is comprised of plastic.

* * * * *